United States Patent [19]

Pawlek et al.

[11] 4,396,481

[45] Aug. 2, 1983

[54] ELECTROLYTIC CELL FOR THE PRODUCTION OF ALUMINUM BY FUSED SALT ELECTROLYSIS

[75] Inventors: Rudolf Pawlek, Sierre; Peter Lagler, Schaffhausen, both of Switzerland

[73] Assignee: Swiss Aluminium Ltd., Chippis, Switzerland

[21] Appl. No.: 247,824

[22] Filed: Mar. 26, 1981

[30] Foreign Application Priority Data

Apr. 3, 1980 [CH] Switzerland ..... 2673/80

[51] Int. Cl.[3] ..... C25C 3/08; C25C 3/12; C25C 11/02; C25C 11/12

[52] U.S. Cl. ..... 204/243 R; 204/291; 204/294

[58] Field of Search ..... 204/67, 243 R, 244–247, 204/294, 291

[56] References Cited

U.S. PATENT DOCUMENTS

| | | | |
|---|---|---|---|
| 3,400,061 | 9/1968 | Lewis et al. | 204/243 R X |
| 3,616,438 | 10/1971 | Foley | 204/245 X |
| 3,647,673 | 3/1972 | Varda et al. | 204/245 X |
| 3,729,398 | 4/1973 | Schmidt-Hatting | 204/245 X |
| 4,071,420 | 1/1978 | Foster, Jr. et al. | 204/243 R X |
| 4,124,476 | 11/1978 | Rapolthy | 204/243 R |
| 4,173,518 | 11/1979 | Yamada et al. | 204/291 X |
| 4,231,853 | 11/1980 | Rahn | 204/243 R |
| 4,333,813 | 6/1982 | Kaplan et al. | 204/243 R |
| 4,338,177 | 7/1982 | Withers et al. | 204/245 X |

*Primary Examiner*—Donald R. Valentine

*Attorney, Agent, or Firm*—Bachman and LaPointe

[57] ABSTRACT

The precipitated liquid metal in a cell for the electrolytic production of aluminum contains, with the exception of its uppermost, freely moveable layer, an electrically conductive granular material.

At least one trough containing molten electrolyte saturated with aluminum oxide is provided outwith the vertical projection of the anode or anodes. The top of the trough lies above the surface of the liquid metal, but is always at least partly below the surface of the electrolyte.

The direct electric current is conducted away from the molten metal by cathode elements which are wet by aluminum.

18 Claims, 2 Drawing Figures

ELECTROLYTIC CELL FOR THE PRODUCTION OF ALUMINUM BY FUSED SALT ELECTROLYSIS

BACKGROUND OF THE INVENTION

The invention relates to an electrolytic cell for the production of aluminum by the fused salt electrolytic process where the said cell comprises a pot containing liquid, precipitated metal and above this a molten electrolyte into which at least one anode dips from above.

To produce aluminum by the electrolytic reduction of aluminum oxide, the latter is dissolved in a fluoride melt which is made up for the greater part of cryolite. The cathodically precipitated aluminum collects under the fluoride melt on the carbon floor of the cell, the surface of the liquid aluminum itself forming the cathode. Anodes which in conventional reduction processes are made of amorphous carbon are secured to an overhead anode beam and dip into the melt from above. At the carbon anodes oxygen is produced as a result of the electrolytic decomposition of the aluminum oxide. This oxygen combines with the carbon in the anodes to form CO and $CO_2$. Electrolysis takes place generally in a temperature range of about 940°–970° C., whereby the electrolyte becomes depleted in aluminum oxide. At a lower concentration of about 1–2 wt.% aluminum oxide in the electrolyte the anode effect occurs, causing an increase in voltage from e.g. 4–4.5 V to 30 V and more. At this time at the latest the crust of solidified electrolyte must be broken open and the concentration of aluminum oxide increased by the addition of fresh aluminum oxide (alumina).

Under normal operating conditions the cell is usually serviced at regular intervals, even if no anode effect occurs, and involves breaking open the crust and adding alumina.

It is known that when large currents are drawn that is higher than 50 kA (kiloampere), the combined effect of vertical components of the magnetic field and horizontal components of the electric current can cause undesirable deformation of the surface of the metal on the floor of the cell, and can lead to undesirable strong flowing of the metal. When the interpolar distance is small this deformation can be so pronounced that aluminum touches the anodes and causes short-circuiting. The flowing of the metal at the surface can also lead to increased chemical dissolution of the aluminum in the electrolyte which, as is well known, results in less efficient use of the applied current. It is therefore impossible to operate with interpolar distances smaller than a certain critical limit. On the other hand the loss of electrical energy is greater the larger the interpolar distance at the same current density. In principle a reduction in current density would be advantageous, however, this would, require unacceptably high investment costs for the cells and the pot room.

Besides various measures and constructions for reducing the vertical components of the magnetic field and the horizontal components of the electrical current, cathode constructions are known whereby these are wet by aluminum and feature a thin layer of aluminum which moves only little in the direction perpendicular to the cathode arrangement, as a result of which the classical surface deformations, both stationary doming and moving waves, are to a large extent eliminated. These wettable materials are, however, very expensive and still have to be shown to have a long service life.

The greatest disadvantage of these arrangements is, however, that the circulation of the electrolyte between anode and cathode is made more difficult and causes the cryolite melt to become depleted in alumina as the aluminum is separated out, thus making the cell prone to the anode effect.

According to U.S. Pat. No. 4,071,420 the circulation of the cryolite melt is improved by the cathode elements, which are in the form of pipes closed at the bottom, projecting, in the region of the anodes, out of the liquid aluminum collected on the rest of the floor of the cell. The pipes are filled completely with aluminum and the interpolar distance can be kept small. The additional amounts of metal produced by the electrolytic process flow into a lower lying sump of liquid aluminum.

There has to be electrical contact between the carbon floor and the aluminum in the above mentioned pipes which are closed at the bottom. The contact may be achieved by the pipe being made of an electrically conductive material or by the aluminum being in direct contact with the conductive cell floor. Apart from the difficult and therefore expensive production of the wettable pipes, this arrangement is effective only when the surface area of aluminum facing the anode is small. This means that the ratio of wettable material to area serving as cathode is high. There is, therefore, no substantial cost savings over other, known cathodes made of wettable materials.

In U.S. patent application Ser. No. 209,124, a cathode arrangement for a molten salt electrolytic cell with relatively small interpolar distance is described, in which there is a granular particulate material in the liquid metal and apart from a top-most, freely moveable layer of at least 2 mm movement of the metal is effectively hindered. The interpolar distance, however, is large enough to ensure free circulation of the molten electrolyte.

It is a principal object of the present invention to further improve the molten salt electrolytic cell described in the foregoing U.S. patent application, in particular with respect to its effects on the environment, length of useful service and economics.

SUMMARY OF THE INVENTION

The foregoing object is achieved by way of the present invention wherein (a) the liquid metal in the pot is at a distance of 10–25 mm from the anode/anodes and with the exception of its uppermost, at least 2 mm deep, freely moveable layer contains an electrically conductive granular material, which lies on the floor of the cell and which is inert and solid at the operating temperature of the cell;

(b) in the region of the pot, however outwith the vertical projection of the anode/anodes, at least one trough containing molten electrolyte saturated with aluminum oxide is provided, and is such that

- the upper edge of the trough, above the surface of the liquid metal, is always kept at least partly below the surface of the electrolyte,
- the interior of the trough is separated from the liquid metal, and
- the opening in the trough, if desired after breaking open the crust, is freely accessible from above, and (c) a plurality of inconsumable cathode elements which are wettable by liquid aluminum penetrate the reduction pot and project into the molten metal containing the said granular material.

It is essential that the particulate bed, claimed as the first characteristic of the combination, never projects out of the molten metal into the molten electrolyte. The uppermost layer of electrolytically deposited aluminum covering the particulate bed is preferably 2–3 mm deep. Usually, at least one tapping hole not covered with the particulate material is provided to allow liquid aluminum to be drawn off from the cell. The particulate material can be fed to the cell by a cell servicing vehicle or cell manipulator, or a known type of device can be fitted to the cell for topping up.

The particle size of the granular material is preferably 0.1 to 100 mm. This particle size must, however, at all events be less than half the depth of the generally 10–100 mm deep particulate bed. This bed is in fact preferably 10 to 50 mm deep. The molten metal penetrates the spaces or pores in the bed and fills these. The movement of the metal is thereby, apart from the uppermost free layer, mechanically restricted. A wave in the metal which would be harmful to the operation of the cell is therefore not able to form. Instead, the wave is prevented or restricted by the material below the metal surface. Examples of suitable materials are compounds which are metallically conductive and are wet by aluminum such as $TiB_2$, TiC, TiN, $ZrB_2$, ZrC, ZrN and mixtures thereof. The particles of granular material can be wholly of these materials or a suitable granular base material can be appropriately coated, for example by the CVD method (CVD=Chemical Vapor Deposition). The particulate material is, usefully, denser than aluminum.

The bed of particulate material in the liquid metal can spread out uniformly over the whole floor of the pot, however, it can, also, as disclosed in U.S. patent application Ser. No. 209,124, be arranged with fence of wire-like intermediate walls which project up close to the upper limit of the granular material facing the anodes, or the floor of the pot can be partially insulated.

The trough which is in the region of the pot but outwith the vertical projection of the anode or anodes, and is claimed as second feature of the combination of the invention, contains molten electrolyte saturated with aluminum oxide such as is used for the electrolytic process. During the operation of the cell, due to the direct contact of the electrolyte circulating in the pot with electrolyte in the trough, there is a continuous exchange of electrolyte which is saturated with aluminum oxide and electrolyte depleted in aluminum as a result of electrolysis.

In a conventional aluminum reduction cell there is usually sufficient movement in the molten electrolyte, due to thermal effects and escape of anode gases, to produce the above-mentioned exchange.

This movement of the electrolyte can if required be assisted by known measures.

During operation of the cell, a trough containing aluminum-oxide-saturated electrolyte projects into the electrolyte layer, but at most partly up to its surface. The trough interior is separated from the liquid, cathodically precipitated aluminum. The trough is made of a material which is able to withstand the liquid aluminum and the electrolyte at the operating temperature.

The trough containing electrolyte saturated with aluminum oxide is, for two reasons, situated outwith the vertical projection of the anode/anodes:

(1) The aluminum oxide consumed in the process is fed exclusively into the trough or troughs, for which reason the above lying region should be as freely accessible as possible.

(2) If the floor of a trough is not electrically insulated, stray currents will also produce aluminum in a trough and this will occur all the more, the closer it is to an anode. As little aluminum as possible should be produced in a trough.

In conventional electrolytic cells with pre-baked anodes, at least one trough containing aluminum-oxide-saturated electrolyte is usefully provided near the longitudinal axis of the cell and can extend in a useful geometric manner along any desirable length of this axis. On the other hand in the particular case of Soederberg cells with only one anode at least one trough is situated at or in the sidewall. In principle the trough could also be situated outside the cell. However this would make greater demands with respect to insulation and circulation of the electrolyte.

The cathode elements which, according to the third feature of the combination according to the invention, project into the electrically conductive particulate material in the liquid metal, pass through the pot wall, preferably at the sides and/or from below. The inconsumable cathode elements which can be set by liquid aluminum and which are in close contact with the granular material in the molten metal are usefully made of titanium di-boride, titanium nitride, zirconium di-boride, zirconium carbide or zirconium nitride.

Although the anodes can have an arbitrary, conventional shape, continuous carbon anodes, in particular also Soederberg anodes, are employed by way of preference. This eliminates the danger of forming sludge on the cell floor, which arises with anode changing. The inconsumable anodes disclosed in U.S. Pat. Nos. 3,960,678 and 3,930,967 which, usefully, have channels to lead off the oxygen formed by the electrolytic process, can be of advantage here to help attain better environmental conditions.

The aluminum reduction cell according to the present invention features a combination of advantages not achieved up to now, for example:

(1) A lower energy consumption which is made possible by a smaller interpolar distance and cathodic elements for conducting the electrical current.

(2) An electrolytic cell with a long service life as a result of the cathodic elements for conducting the current.

(3) A high current yield.

(4) Trouble-free hooding of the cell.

The advantages of the preferred continuous or inconsumable anodes have already been mentioned. It should be emphasized however that in the absence of sludge on the cell floor no anode effects, which disturb the continuous operation of the cell, are necessary.

BRIEF DESCRIPTION OF THE DRAWINGS

The essential features of the present invention are explained in greater detail hereinbelow with the help of schematic drawings showing vertical sections through the lower part of cells for molten salt electrolysis wherein.

DETAILED DESCRIPTION

Figure 1:
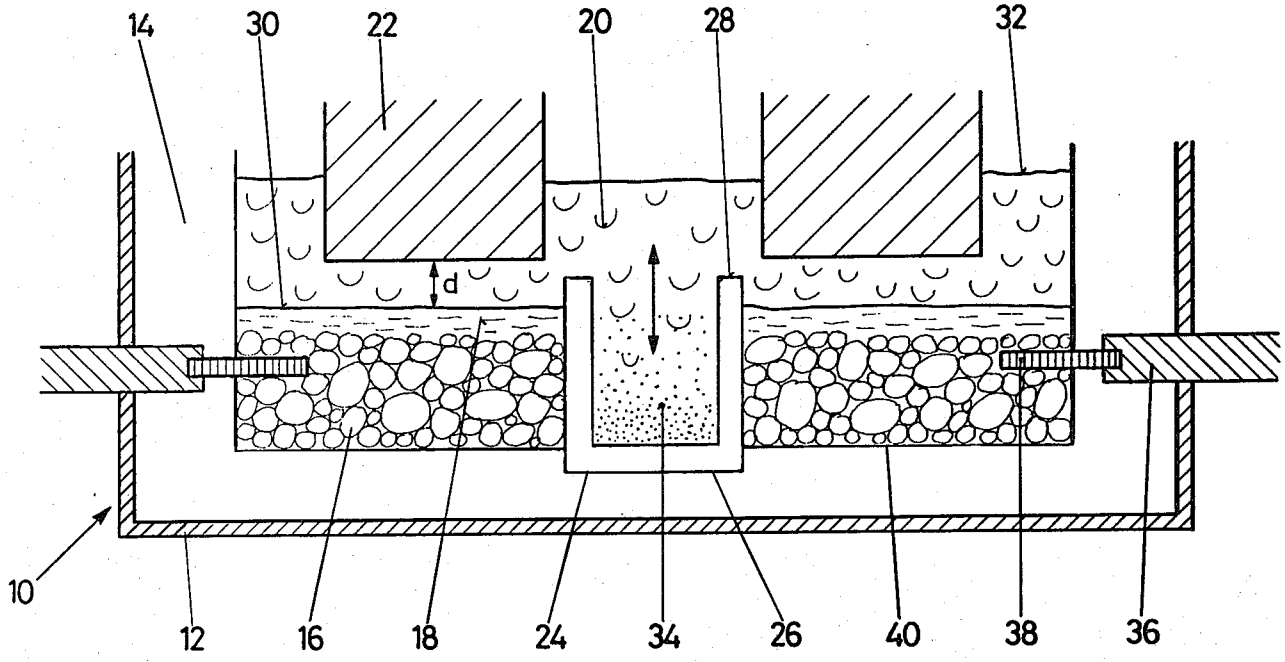
FIG. 1: A section through a cell with a plurality of anodes, a trough situated in the longitudinal axis of the cell, and at the sides electrical busbars for the cathode.

The pot 10 comprises an outer steel casing 12 with insulation which is not shown here. On the inside is a lining 14 made of carbon or other materials which are resistant to cryolite and aluminum such as, for example, titanium cyanonitride, nitride bonded silicon carbide or a fluoride compound having the formula $nXF(AlF_3)$ where X is at least one alkali metal e.g. $Na_3AlF_6$. According to another version not shown here the pot can also be made of concrete.

Lying in the pot is the granular material 16 in liquid aluminum 18 the uppermost layer of which does not contain the granular material i.e. can move freely. Dipping into the molten electrolyte 20 is a plurality of anodes 22 (FIG. 1) or one anode 22 (FIG. 2) which is/are at a distance d from the liquid metal.

FIG. 1 shows a pre-fabricated trough 24 made of a material resistant to liquid aluminum and electrolyte, which has been inserted in a trough-shaped recess 26 in the floor 40 in the longitudinal axis of the cell and secured in place by clamping or using a suitable binding material. In principle the trough can be made of the same materials as the lining of the pot 10.

The trough can also be formed in the cell floor itself i.e. the lining of the pot and the trough can be in one piece. Furthermore, the shape of the trough can be maintained by pushing and clamping pre-shaped sidewalls into the recess in the floor 40 which, in this case, also forms the floor of the trough.

Figure 2:
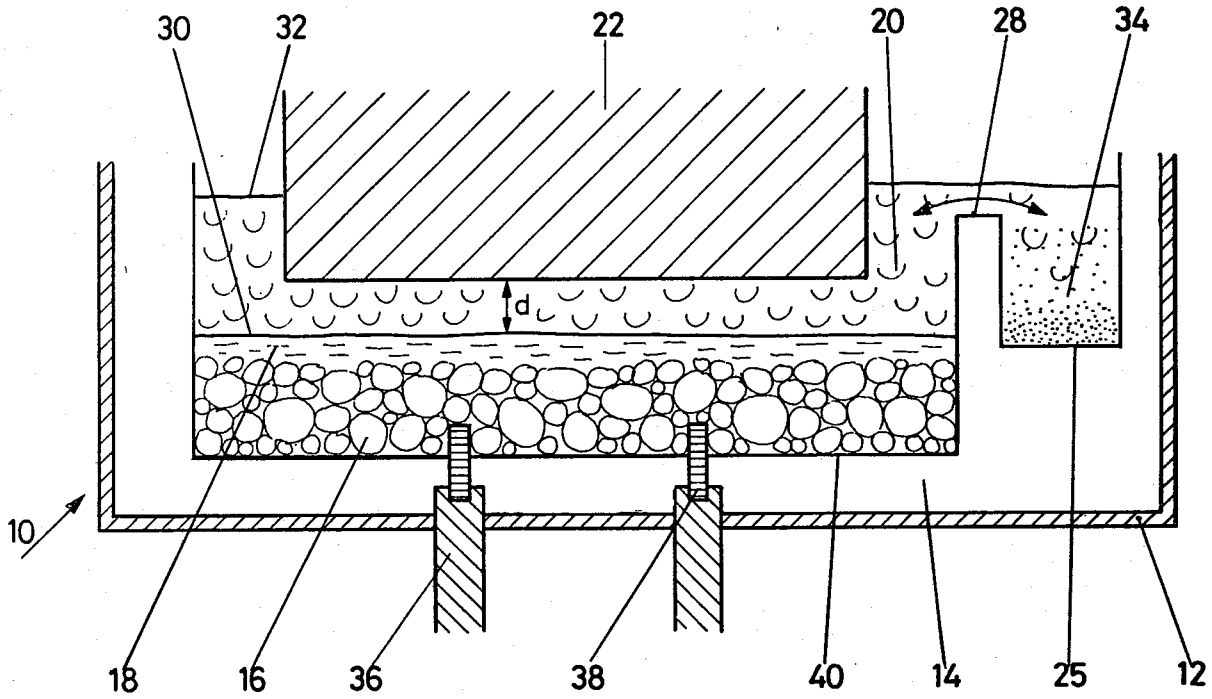
FIG. 2: A section through a cell with a Soederberg anode, a trough in the pot lining, and busbars for the cathode coming from below.

FIG. 2 shows a trough 25 formed in the lining 14 of the cell.

One small trough, a plurality of small troughs or one trough extending over a larger part of the longitudinal cell axis can be provided in the longitudinal axis of the cell or the cell lining.

The upper edges 28 of a trough project so far into the electrolyte 20 that they lie at least 1 cm above the highest level of the metal surface 30 and at least 1 cm below the highest level of the surface 32 of the electrolyte.

Although the geometric shape of the troughs is not important, for reasons concerned with their manufacture, preferred troughs are those with square, rectangular or round horizontal cross sections, and vertical or approximately vertical walls.

Each trough contains an electrolytic solution which is saturated with aluminum oxide and which is also called the alumina sump 34. The aluminum oxide consumed in the electrolytic process is continuously replaced as a result of convection and the movement of circulation in the electrolyte.

The outer part of the pot 10 is penetrated by cathodic electrical busbars 36 made e.g. of aluminum or copper. The cathodes 38 which are wet by the liquid aluminum 18 are set in the wall of the pot 10 and connected electrically to the busbars 36.

Finally, in order to simplify the tapping of the cell, the floor 40 of the cell can be made with a slight inclination so that the liquid metal is led to a tapping hole which is not covered with granular material.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. An electrolytic cell for use in the production of aluminum comprising:

a pot having a floor and sidewalls;

a melt of liquid aluminum positioned within said pot on said floor having a top surface at a height $h_1$ with respect to said floor;

a molten electrolyte positioned within said pot on said melt having a top surface at a height $h_2$ with respect to said floor;

at least one vertically projecting anode positioned within said pot and in said molten electrolyte such that the top surface of said melt is a distance d from the bottom surface of said at least one vertically projecting anode;

melt movement suppression means provided within said pot and in said melt having a top surface at a distance $h_3$ with respect to said floor wherein $h_3 < h_1$ such that the top surface of said melt movement suppression means is a distance a from said top surface of said melt; and trough means radially spaced from said at least one vertically projecting anode having a top edge at a distance $h_4$ with respect to said floor wherein $h_1 < h_4 < h_2$ such that the interior of said trough is separated from said melt.

2. An electrolytic cell according to claim 1 wherein a plurality of inconsumable cathode elements penetrate said pot and project into said melt and said melt movement suppression means.

3. An electrolytic cell according to claim 2 wherein said plurality of inconsumable cathode elements are wetted by liquid aluminum.

4. An electrolytic cell according to claim 1 wherein said trough contains said molten electrolyte saturated with aluminum oxide.

5. An electrolytic cell according to claim 1 wherein said melt movement suppression means comprises a bed of particulate material.

6. An electrolytic cell according to claim 5 wherein said particulate material is selected from the group consisting essentially of $TiB_2$, TiC, TiN, $ZrB_2$, ZrC, ZrN and mixtures thereof.

7. An electrolytic cell according to claim 5 wherein the particle size of said particulate material is from 0.1 to 100 mm.

8. An electrolytic cell according to claim 5 wherein the particle size of said particulate material is at most less than $\frac{1}{2}$ the height of said bed.

9. An electrolytic cell according to claim 1 wherein said at least one anode is a Soederberg carbon anode.

10. An electrolytic cell according to claim 1 wherein said at least one anode is an inconsumable anode made of oxy-ceramic material.

11. An electrolytic cell according to claim 1 wherein said cell comprises a plurality of anodes and said trough is positioned between said anodes along the entire length of said cell.

12. An electrolytic cell according to claim 1 wherein said trough is situated in the vicinity of the sidewalls of said cell.

13. An electrolytic cell according to claim 1 wherein said trough is formed at least in part by said floor of said cell.

14. An electrolytic cell according to claim 1 wherein said plurality of inconsumable cathode elements contain at least in part material selected from the group consisting essentially of $TiB_2$, TiC, TiN, $ZrB_2$, ZrC, ZrN and mixtures thereof.

15. An electrolytic cell according to claim 1 wherein the distance d is from 10 to 25 mm.

16. An electrolytic cell according to claim 1 wherein the distance a is at least 2 mm.

17. An electrolytic cell according to claim 1 wherein the height $h_3$ is 10 to 100 mm.

18. An electrolytic cell according to claim 1 wherein the height $h_3$ is 10 to 50 mm.

* * * * *